US006231687B1

(12) United States Patent
Kobayashi et al.

(10) Patent No.: US 6,231,687 B1
(45) Date of Patent: May 15, 2001

(54) LUBRICATION TREATMENT METHOD FOR COLD WORKING OF STEEL

(75) Inventors: Naoyuki Kobayashi; Masahiko Kawakami, both of Nagoya (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/413,931

(22) Filed: Oct. 7, 1999

(30) Foreign Application Priority Data

Oct. 7, 1998 (JP) ..... 10-300373

(51) Int. Cl.[7] ..... C23C 22/82

(52) U.S. Cl. ..... 148/246; 148/256; 148/257; 148/260; 148/262; 427/334; 427/418

(58) Field of Search ..... 148/246, 256, 148/257, 260, 262; 427/334, 418

(56) References Cited

U.S. PATENT DOCUMENTS

| | | | | |
|---|---|---|---|---|
| 4,517,029 | | 5/1985 | Sonada et al. | 148/246 |
| 4,688,411 | * | 8/1987 | Hagita et al. | 72/39 |
| 4,944,813 | * | 7/1990 | Hosemann et al. | 148/260 |
| 5,234,509 | * | 8/1993 | Tull | 148/262 |
| 5,236,565 | * | 8/1993 | Muller et al. | 148/262 |

FOREIGN PATENT DOCUMENTS 60-20463 5/1985 (JP) .

* cited by examiner

*Primary Examiner*—John Sheehan
*Assistant Examiner*—Andrew L. Oltmans
(74) *Attorney, Agent, or Firm*—Wayne C. Jaeschke; Stephen D. Harper; Norvell E. Wisdom, Jr.

(57) ABSTRACT

A phosphating solution that contains from 3 to 30 g/l of zinc ions, from 0.1 to 20 g/l of ferrous ions, from 5 to 60 g/l of phosphate ions, from 5 to 60 g/l of nitrate ions, and a source of hydroxylamine in a concentration corresponding stoichiometrically to from 0.5 to 4 g/l of hydroxylamine and in which there is a weight ratio of zinc to phosphate that is from 0.1:1 to 1:1 deposits on steel to be cold worked a phosphate conversion coating suitable as a lubricant carrier. This phosphating solution, which may optionally contain one or more of calcium, nickel, cobalt, and copper cations and simple and complex fluorine-containing anions, makes it possible to lower the temperature of the treatment solution, reduce the amount of sludge, improve the quality of the coating film, and allow single-liquid type replenishment to be used. Preferably the surface to be phosphated is immersed in the phosphating solution, maintained at a temperature of 35 to 80° C., for 2 to 20 minutes.

20 Claims, 1 Drawing Sheet

LUBRICATION TREATMENT METHOD FOR COLD WORKING OF STEEL

BACKGROUND OF THE INVENTION

The present invention concerns a treatment method which is used to form a lubricating coating film that is suitable for cold plastic working, i. e., wire drawing, tube drawing, forging or header working, etc., that is performed while the metal is cold, on the surface of ferriferous metals such as low-carbon steel, high-carbon steel and low-alloy steel, and the like. (Hereinafter, unless otherwise noted, the simple term "steel" is to be understood as encompassing all such materials, and the shorter phrase "cold working" implies "cold plastic working").

When steel is subjected to cold working, the surface to be worked, called the "workpiece", is provided with a lubrication treatment beforehand in order to reduce wear on at least one working tool surface, between which and the workpiece surface mechanical force is exerted during cold working to cause the desired deformation of the workpiece to be accomplished by the cold working, and to prevent sticking of the material being worked to the tools. If the degree of deformation of the workpiece to be accomplished by the cold working performed is relatively low, an oil, which may contain extreme-pressure additives and/or additives that improve the lubricative properties of the oil, may be satisfactorily used as the only lubrication treatment. In cases where a high degree of deformation of the workpiece is desired, a two-stage lubrication method is widely used. First a zinc phosphate type conversion treatment is formed on the workpiece surface by contacting it with a suitable zinc phosphating liquid composition containing (for example) nitrite as an oxidizing agent, with this treatment solution being heated to a temperature of 70 to 80° C. After a conversion coating is thereby formed on the surface, the conversion coated surface is then contacted with a soluble metal soap solution whose main component is (for example) sodium stearate (e. g., PALUBE® 235 treatment manufactured by Nihon Parkerizing Co., Ltd.). During this contact, the stearate solution is heated to a temperature of 70 to 90° C., so that a zinc stearate lubricating layer is formed on the surface of the zinc phosphate coating film and a sodium stearate layer is formed on top of this zinc stearate lubricating layer. Furthermore, research on improvement of the underlayer coating film has been conducted with the aim of improving the performance of such a lubrication treatment coating film. Some results of such research are disclosed in Japanese Patent Application Kokoku No. 60-20463. The conversion coating treatment used in the invention of this reference is performed at a temperature of approximately 80° C., using a zinc-calcium phosphate type treatment solution with specified component concentrations.

When the two types of underlayer treatments using the above mentioned zinc phosphate type treatment solution and zinc-calcium phosphate type treatment solution are examined, it is found that both treatments require a high formation treatment temperature, and both result in the generation of large amounts of sludge in the treatment solution. In addition, the following problem also arises: Large amounts of nitrites are used as oxidizing agents, and since these nitrites break down in a concentrated acidic replenishing agent, they must be replenished from a separate replenishing tank.

The object of the present invention is to provide a lubrication treatment method for use in cold working of steel, which method includes an operation of forming a zinc or zinc-calcium phosphate conversion coating and makes it possible to achieve at least one of the following benefits compared with the prior art: to lower the temperature of the treatment solution, to reduce the amount of sludge, to improve the quality of the cold-worked underlayer beneath the coating film that is formed, and to make single-liquid type replenishment practical (because there is no decomposition in a concentrated acidic replenishment composition).

BRIEF SUMMARY OF THE INVENTION

It has been found that an excellent zinc or zinc-calcium phosphate conversion coating can be formed, and a lubricating coating film which has cold working characteristics superior to those obtained in conventional techniques can be formed over this conversion coating, by causing a specified content of a salt or complex salt of hydroxylamine to be present in the phosphate conversion coating liquid composition, which also contains a higher concentration of ferrous ions than is usual in phosphating solutions, and by controlling the concentrations of the other components in the treatment solution in parallel with the above mentioned means.

BRIEF DESCRIPTION OF THE DRAWINGS

FIGS. 2*a* through 2*d* are projection views of test substrates used in this test before being mechanically worked, while

DETAILED DESCRIPTION OF THE INVENTION AND PREFERRED EMBODIMENTS

Figure 3D:
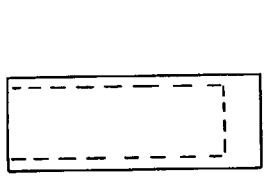
FIGS. 3*a* through 3*d* are projection views of the same test substrates after being punched.
Figure 2D:
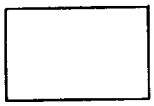
Figure 3C:
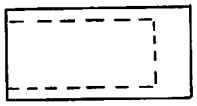
Figure 2C:
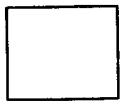
Figure 3B:
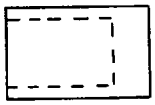
Figure 2B:
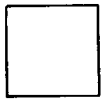
Figure 3A:
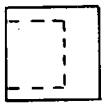
Figure 2A:
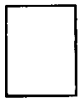

In a lubrication treatment method according to the invention for use prior to cold working of steel, a phosphate coating film is formed on the surface of the steel by contacting the steel surface with an aqueous liquid phosphate conversion coating composition that comprises, preferably consists essentially of, or more preferably consists of, water and the following components:

(A) dissolved zinc cations at a concentration of 3 to 30 grams per liter of total composition, this unit of concentration being hereinafter usually abbreviated as "g/l";

(B) dissolved ferrous ions at a concentration of 0.1 to 20 g/l;

(C) dissolved phosphate ions at a concentration of 5 to 60 g/l;

(D) dissolved nitrate ions at a concentration of 5 to 60 g/l; and (E) a dissolved hydroxylamine source at a concentration of 0.5 to 4 g/l, calculated as its stoichiometric equivalent as pure hydroxylamine; and, optionally, one or more of the following components:

(F) dissolved calcium ions at a concentration of 2 to 20 g/l;

(G) dissolved metal cations selected from the group consisting of nickel, cobalt, copper; and (H) dissolved simple or complex fluoride anions, the weight ratio of zinc ions to phosphate ions in the composition being in a range from 0.1:1 to 1:1 and, if calcium is present in the composition, the weight ratio of calcium ions to zinc ions being in a range from 0.2:1.0 to 4:1.0, or preferably from 0.2:1.0 to 2:1.0.

After the phosphate conversion coating has thus been formed, a lubricating coating film is formed on the surface of the aforementioned phosphate film.

The aforementioned treatment solution contains zinc ions and ferrous ions as essential cationic components. The zinc ions concentration preferably is at least 5 g/l. In cases where this concentration is less than 3 g/l, forming a coating film that is suitable for cold working tends to become difficult. On the other hand, if this concentration exceeds 30 g/l, there is no corresponding improvement in the formation treatment characteristics; on the contrary, control of the treatment solution becomes difficult, and such a large zinc concentration is also undesirable from an economic standpoint.

If the ferrous ions concentration is less than 0.1 g/l, the effect of the phosphate coating film that is formed as a lubricating underlayer is usually insufficient. Furthermore, in order to restrict the iron concentration in this way, ferrous iron which is naturally formed by the dissolution of the workpiece surface when this surface is in contact with the phosphating composition must be removed by the frequent addition of an oxidizing agent ($NaNO_2$, $H_2O_2$, or the like), to oxidize the ferrous cations to ferric cations that precipitate as ferric phosphate sludge; as a result, the amount of sludge is increased. Conversely, if this concentration exceeds 20 g/l, a coarse, incomplete coating film tends to be formed. Such a coating has less protective value.

The phosphate ions concentration preferably is at least 10, or more preferably at least 15, g/l. If this concentration is less than 5 g/l, the coating film formation characteristics deteriorate. Conversely, phosphate ions may be present at a concentration exceeding 60 g/l; in such a case, however, this merely increases the cost without causing any corresponding improvement in the formation characteristics.

Independently, it is preferable that the weight ratio of zinc ions to phosphate ions be from 0.25:1.0 to 0.75:1.0. In cases where this ratio is less than 0.1, the formation defect of blue color tends to occur. Conversely, if this ratio exceeds 1, then the formation characteristics deteriorate.

The nitrate ions concentration preferably is from 13 to 55 g/l. If this concentration is less than 5 g/l, the coating film formation rate is so retarded that considerable time is required for the treatment. Conversely, if this concentration exceeds 60 g/l, there is a deterioration in the formation characteristics.

An essential component besides the abovementioned components is a hydroxylamine source at a concentration of 0.5 to 4 g/l, calculated as the stoichiometric equivalent amount of pure hydroxylamine, in the phosphate treatment solution used in the present invention. Hydroxylamine promotes forming a phosphate coating film which has relatively fine crystal particles, even at a low temperature in a phosphating composition containing iron. If the concentration of the aforementioned hydroxylamine source in the phosphating composition is less than 0.5 g/l, coating film formation is either small or completely absent. Conversely, in cases where the amount of hydroxylamine exceeds 4 g/l, the formation defect of blue color tends to occur.

From a zinc phosphate type treatment solution as described above without calcium, a homogeneous coating film is formed with hopeite (i.e., $Zn_3(PO_4)_2 \cdot 4H_2O$) crystals constituting the main component and phosphophyllite (i.e., $Zn_2Fe(PO_4)_2 \cdot 4H_2O$) being co-deposited with this hopeite. However, if a sufficient concentration of calcium ions is included in the treatment solution as described above, then a fine homogeneous coating film will be formed in which scholzite (i.e., $Zn_2Ca(PO_4)_2 \cdot 2H_2O$) constitutes the main component, and hopeite and phosphophyllite are co-deposited with this scholzite. However, if the calcium ions concentration is at least 0.1 but less than 2 g/l, or if the weight ratio of calcium ions to zinc ions is at least 0.01 but is less than 0.2, the coating film often is non-uniform in terms of crystal structure. Especially in the case of heavy cold working, a microscopically uniform coating film is preferred; accordingly, such a non-uniform coating film is undesirable as an underlayer for heavy cold working. Conversely, in cases where the calcium ions concentration exceeds 20 g/l, or in cases where the weight ratio of calcium ions to zinc ions exceeds 4, relatively soft monetite (i.e., $CaHPO_4$) is deposited between the aforementioned fine crystals, so that the cold working characteristics deteriorate. Furthermore, if the concentration of zinc ions in the phosphate treatment solution that contains calcium is less than 3 g/l, relatively soft monetite tends to be co-deposited in the formed coating film. On the other hand, in cases where the zinc ions concentration exceeds 30 g/l, co-deposited crystals of hopeite and phosphophyllite tend to form among the aforementioned fine crystals, so that the coating film tends to become non-uniform in terms of crystal structure. Accordingly, neither the abovementioned low concentration nor the abovementioned high concentration is desirable.

All of the other preferences stated herein apply whether or not the phosphating composition used in a process according to the invention contains calcium cations within preferred ranges as set forth above.

It can be advantageous, although it is not necessary, to include in the phosphate conversion coating treatment composition used in a process according to the invention one or more of nickel ions, cobalt ions, copper ions, simple fluoride ions and complex fluoride ions. Any one or more of these optional components promote at least slightly improved fine crystallinity and freedom from pores in the coatings formed.

Even though it contains iron, a conversion coating composition of the present invention with the components described above makes it possible to form on the surface of steel a finely crystalline coating film that has a coating film weight of 7 to 12 grams per square meter of surface coating, a unit of coating weight that is hereinafter usually abbreviated as "$g/m^2$". Such a coating may be formed by immersion of the steel for 2 to 20 minutes at a treatment temperature of 35 to 80° C., and each of these ranges for coating weight, contact time between the steel substrate and the phosphating composition, and temperature maintained during such contact, is independently preferred for a process according to the invention. A coating film formed under these conditions almost always constitutes an underlayer which is suitable for a high degree of cold working. Furthermore, it was also found that in the temperature range of 35 to 65° C., the amount of sludge that is produced can be greatly reduced compared to the amount produced in conventional techniques.

A complete process according to the invention preferably includes the following operations after coating film formation and before applying the lubricating layer: rinsing with water and then either drying or neutralizing following coating film formation. The lubrication treatment performed following rinsing with water usually employs a lubricating agent containing a solid lubricant such as molybdenum disulfide, tungsten disulfide, graphite, or the like or a lubricating oil, often containing an extreme-pressure additive. A method which is widely used to perform a lubrication treatment following neutralization is a method in which a weakly alkaline aqueous solution of a metal soap consisting chiefly of an alkali metal salt of a saturated or unsaturated $C_{16}$ to $C_{18}$ fatty acid, ordinarily sodium stearate, is heated to a temperature of 70 to 90° C., and is immersed in this solution, whereupon the zinc phosphate coating film and the alkali metal salt react so that a zinc salt layer that has the same anions as the alkali metal salt and that is chemically bonded to the metal surface is formed. This type of treatment is especially desirable prior to very heavy cold working.

The operation and benefits of the present invention may be further appreciated from consideration of the following working examples and comparative examples.

Evaluation of the lubrication properties was accomplished by means of a backward punching test and a Bowden test. An outline of the test methods is given below.

BACKWARD PUNCHING TEST

Figure 1:
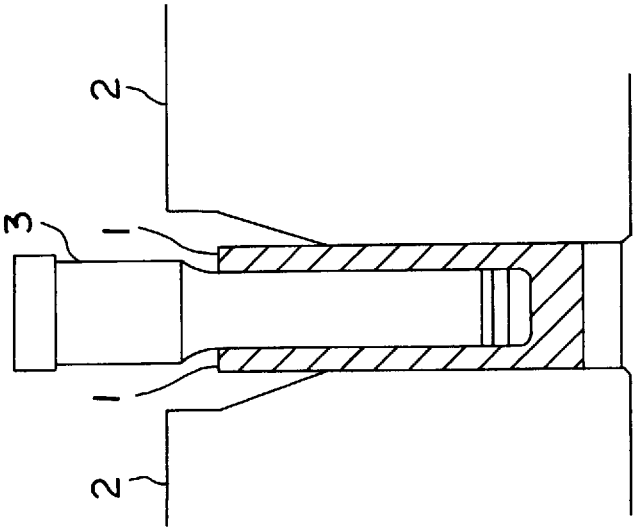
FIG. 1 is a cross-sectional view of apparatus used in a backward punch test that was run to test the efficacy of lubricant compositions and processes according to the present invention.

This test was performed on a 200-ton cold casting crank press with a stroke rate of 30 strokes per minute. The most important physical details of the apparatus and test specimens are illustrated in the drawing figures. In the backward punch test procedure, the dies 2 in FIG. 1 were set to bind the circumference of the cylindrical test specimens 1 as illustrated in FIG. 1, and the specimen was then subjected to a downward stroke from a punch 3 also shown in FIG. 1. The generally cylindrical punch had an outside diameter over most of its working length of 21.0 millimeters (hereinafter usually abbreviated as "mm") but at its lower end had a section 10 mm in length in which the outside diameter was increased to 21.21 mm in the upper 4 mm of its length, this cylindrical surface being connected to the flat bottom surface of the die by a surface which in cross section had the form of a quarter-circle with a diameter of 6 mm. These dimensions resulted in a 50% cross section reduction of the test specimen 1 and produced a cup-like molding as shown in FIGS. 3*a* through 3*d*. The lower dead point of the press was adjusted to give a 10 millimeters residual margin at the bottom of the test specimen. In this test, different test specimens with a diameter of 30 mm and a height of 16 to 40 mm in 2 mm increments were placed in the die 2, starting with the shortest test specimen. Each test specimen tested was punched from above with the punch already described above. These conditions were such that the taller the test piece, the greater was the cold working. The inner surface of the cup was examined after this working, and the test was concluded at the point when scratches were noted. The maximum depth of the hole at which no scratches occurred was termed the good punching depth.

BOWDEN TEST

This test used equipment manufactured by Toyo Baldwin K. K. During the test, a pressing element with a hemispherical end having a diameter of 2.5 mm is pressed against the surface to be tested with a force of 5 kilograms as the pressing element slides back and forth along a path 10 mm in length at a speed of 10 mm per second at a test temperature of 25° C. The lubricating properties were evaluated by measuring the number of times of sliding possible before sticking of the test specimen, as evidenced by a coefficient of friction of 0.25 or greater between the pressing element and the tested surface, occurred.

EVALUATION OF EXTERNAL APPEARANCE OF PHOSPHATE COATING FILM

The external appearance of the phosphate coating film on the surface of the test specimen was evaluated according to the scale shown below:

○: No thin spots in the external appearance of the coating film.

Δ: Some thin spots present in the external appearance of the coating film.

x: Formation of coating film unsatisfactory.

WORKING EXAMPLES 1 THROUGH 8 AND COMPARATIVE EXAMPLES 1–7

Cylindrical test specimens of S40C were cleaned by contact with acid, rinsed with water, and then treated with the respective phosphate treatment solutions shown in Table 1 below. After this treatment, the now coated surfaces were rinsed with water and neutralized. Next, the test specimens were immersed for 5 minutes at 80° C. in a 70 g/l solution of a soap lubricating agent PALUBE® 235 (manufactured by Nihon Parkerizing Co., Ltd., which contains sodium stearate as its major active ingredient along with auxiliary components sodium borate and sodium nitrite. The coating that remained on the workpiece surface after this immersion and removal of the workpiece from contact with the soap lubricating agent was dried into place on the workpiece surface. Afterward, the lubricating properties were evaluated by means of a backward punching test and Bowden test. The results of an evaluation of the external appearance of the phosphate coating films formed on the test specimens, the weights of the phosphate coating films formed by the phosphate treatment, ratios of zinc to phosphate and, where applicable, of calcium to zinc, and the amounts of metal soap and amounts of sludge generated are shown in the second part of Table 1. The results of the backward punching test and of the Bowden test are shown in Table 2 (these tests were not performed for Comparative Examples 1 through 3). In Table 1, "Ex" means a working example and "CE" means a comparative example. Comparative Examples 1 through 7 fail to fall within the limits of the invention for the following reasons:

In Comparative Example 1 the zinc ions concentration is too low.

In Comparative Example 2 the hydroxylamine concentration is too low.

In Comparative Example 3 the hydroxylamine concentration is too high.

In Comparative Example 4 the w eight ratio of calcium ions to zinc ions is too low.

In Comparative Example 5 the weight ratio of calcium ions to zinc ions is too high.

In Comparative Examples 6 and 7, the former without and the latter with calcium ions, no hydroxylamine was added and a conventional nitrite accelerator was used instead.

On the basis of the results shown in Tables 1 and 2, the following statements may be made.

TABLE 1

| | Concentration in g/l in the Phosphating Composition of: | | | | | | | | |
|---|---|---|---|---|---|---|---|---|---|
| Identifier | $PO_4^{-3}$ | $NO_3^-$ | $Zn^{+2}$ | $Ca^{+2}$ | $Fe^{+2}$ | $Ni^{+2}$ | $Cu^{+2}$ | $H_2NOH$ | $NO_2^-$ |
| Ex 1 | 15 | 13 | 5 | 0 | 0.1 | 0 | 0 | 0.5 | — |
| Ex 2 | 15 | 13 | 10 | 0 | 0.1 | 1 | 0 | 0.5 | — |
| Ex 3 | 29 | 25 | 25 | 0 | 10 | 0 | 5 | 2 | — |
| Ex 4 | 50 | 45 | 30 | 0 | 15 | 1 | 5 | 4 | — |
| Ex 5 | 20 | 19 | 10 | 5 | 0.1 | 0 | 0 | 0.5 | — |
| Ex 6 | 20 | 19 | 15 | 5 | 10 | 0 | 5 | 0.5 | — |
| Ex 7 | 40 | 35 | 20 | 20 | 10 | 1 | 5 | 2 | — |
| Ex 8 | 60 | 55 | 15 | 30 | 15 | 1 | 5 | 4 | — |
| CE 1 | 15 | 13 | 1 | 0 | 0.1 | 1 | 0 | 2 | — |
| CE 2 | 15 | 13 | 10 | 0 | 5 | 1 | 5 | 0.1 | — |
| CE 3 | 15 | 13 | 10 | 0 | 5 | 0 | 0 | 5 | — |
| CE 4 | 20 | 19 | 15 | 1 | 10 | 0 | 5 | 4 | — |

TABLE 1-continued

| | | | | | | | | | |
|---|---|---|---|---|---|---|---|---|---|
| CE 5 | 20 | 19 | 3 | 15 | 15 | 1 | 5 | 2 | — |
| CE 6 | 14 | 16 | 12 | 0 | 0 | 1 | 0 | — | 0.01 |
| CE 7 | 20 | 15 | 11 | 3 | 0 | 0 | 0 | — | 0.01 |

| | Ratios in Composition: | | Process Conditions | | Appearance | Grams per Square Meter of: Phosphate | Sludge | Metal Soap |
|---|---|---|---|---|---|---|---|---|
| Identifier | $Zn:PO_4$ | Ca:Zn | ° C. | Time, Minutes | Rating | Coated | Formed | Coated |
| Ex 1 | 0.33 | — | 65 | 10 | ○ | 7.8 | 12.6 | 3.5 |
| Ex 2 | 0.67 | — | 50 | 10 | ○ | 8.5 | 13.2 | 3.8 |
| Ex 3 | 0.86 | — | 80 | 5 | ○ | 9.2 | 22.1 | 2.5 |
| Ex 4 | 0.60 | — | 40 | 10 | ○ | 10.5 | 11.4 | 2.8 |
| Ex 5 | 0.50 | 0.20 | 50 | 5 | ○ | 8.2 | 8.9 | 3.4 |
| Ex 6 | 0.75 | 0.33 | 70 | 5 | ○ | 8.0 | 24.5 | 3.5 |
| Ex 7 | 0.50 | 1.00 | 50 | 2 | ○ | 9.2 | 11.8 | 2.7 |
| Ex 8 | 0.25 | 2.00 | 65 | 5 | ○ | 9.6 | 9.5 | 3.2 |
| CE | 0.07 | — | 65 | 10 | X | — | — | — |
| CE 2 | 0.67 | — | 50 | 5 | X | — | — | — |
| CE 3 | 0.67 | — | 80 | 10 | X | — | — | — |
| CE 4 | 0.75 | 0.07 | 65 | 10 | Δ | 4.2 | 27.4 | 1.5 |
| CE 5 | 0.15 | 5.00 | 70 | 5 | Δ | 3.4 | 25.9 | 0.7 |
| CE 6 | 0.86 | — | 80 | 5 | ○ | 8.4 | 32.8 | 2.4 |
| CE 7 | 0.55 | 0.27 | 80 | 10 | ○ | 7.5 | 34.5 | 2.4 |

TABLE 2

| | Lubrication Quality test Results | |
|---|---|---|
| Identifier | Number of Slides Before Sticking in Bowden Test | Good Punch Depth, mm |
| Working Example 1 | 2200 | 46 |
| Working Example 2 | 2400 | 48 |
| Working Example 3 | 2300 | 46 |
| Working Example 4 | 2500 | 47 |
| Working Example 5 | 2300 | 46 |
| Working Example 6 | 2500 | 47 |
| Working Example 7 | 2200 | 47 |
| Working Example 8 | 2400 | 46 |
| Comparative Example 4 | 1500 | 37 |
| Comparative Example 5 | 1300 | 35 |
| Comparative Example 6 | 1900 | 42 |
| Comparative Example 7 | 2000 | 44 |

Working Examples 1 through 7 show a deep limiting depth at which sticking occurs in the backward punching test, and these examples are also superior in terms of resistance to sticking in the Bowden test. The weights of the phosphate coating films and the amounts of metal soap are large, and the amounts of sludge generated are small.

In contrast, Comparative Examples 1 through 3 show an extremely poor external appearance of the phosphate coating film obtained in comparison with Working Examples 1 through 7.

In Comparative Examples 4 and 5, the limiting good punch depth and the resistance to sticking in the Bowden test are extremely poor; furthermore, the weights of the phosphate coating films and the amounts of metal soap are small, and the amounts of sludge generated are large.

Comparative Examples 6 and 7 show a poor good punch depth and a poor resistance to sticking; furthermore, the weights of the phosphate coating films and the amounts of metal soap are small, and the amounts of sludge generated are large.

The lubrication treatment method of the present invention under preferred conditions possesses the following merits:

A finely crystalline phosphate coating film is formed, so that an underlayer coating film suitable for intensive cold working is obtained.

There is no need for strong oxidizing agents during the treatment, so that control of the treatment solution is relatively easy, and a single liquid replenisher can be used.

The amount of sludge generated from the treatment solution is small.

The lubricating coating film obtained by the process of the present invention has superior cold working properties.

The invention claimed is:

1. A process for lubricating a steel workpiece surface prior to cold working that will cause deformation of the workpiece surface by mechanical force exerted between said surface and a distinct working tool surface, said process comprising operations of:

(I) forming a phosphate conversion coating over said workpiece surface by contacting it with an aqueous phosphating composition comprising water and the following components:

(A) dissolved zinc cations at a concentration of 3 to 30 g/l;

(B) dissolved ferrous ions at a concentration of 0.1 to 20 g/l;

(C) dissolved phosphate ions at a concentration of 5 to 60 g/l;

(D) dissolved nitrate ions at a concentration of 5 to 60 g/l; and (E) a dissolved hydroxylamine source at a concentration of 0.5 to 4 g/l, calculated as its stoichiometric equivalent as pure hydroxylamine; and, optionally, one or more of the following components:

(F) dissolved calcium ions at a concentration of 2 to 20 g/l;

(G) dissolved metal cations selected from the group consisting of nickel, cobalt, copper; and (H) dissolved simple or complex fluoride anions, the weight ratio of zinc ions to phosphate ions in said phosphating composition being in a range from 0.1:1 to 1:1 and, if calcium is present in the composition at a concentration of at least 0.1 g/l, the weight ratio of calcium ions to zinc ions being in a range from 0.2 to 4; and (II) forming over the phosphate conversion coating formed in operation (I) a distinct lubricant coating.

2. A process according to claim 1, wherein said phosphating composition comprises at least one substance selected from a group consisting of nickel cations, cobalt cations, copper cations, and simple and complex fluorine containing anions.

3. A process according to claim 2, wherein, in said phosphating composition:

the concentration of zinc is at least 5 g/l;

the concentration of phosphate is at least 10 g/l;

the weight ratio of zinc ions to phosphate ions is from 0.25:1.0 to 0.75:1.0;

the nitrate ions concentration is from 13 to 55, g/l.; and if calcium is present in the composition at a concentration of at least 0.1 g/l, the ratio by weight of calcium to zinc is from 0.2:1.0 to 2:1.0.

4. A process according to claim 1, wherein, in said phosphating composition:

the concentration of zinc is at least 5 g/l;

the concentration of phosphate is at least 10 g/l;

the weight ratio of zinc ions to phosphate ions is from 0.25:1.0 to 0.75:1.0;

the nitrate ions concentration is from 13 to 55, g/l.; and if calcium is present in the composition at a concentration of at least 0.1 g/l, the ratio by weight of calcium to zinc is from 0.2:1.0 to 2:1.0.

5. A process according to claim 4, additionally comprising an operation of rinsing the phosphate conversion coating formed in operation (I) with water before performing operation (II).

6. A process according to claim 5, wherein:

after rinsing the phosphate conversion coating with water, the coating is dried before performing operation (II); and in operation (II), the outer surface of the dried phosphate conversion coating is:

coated with a solid lubricant selected from the group consisting of molybdenum disulfide, tungsten disulfide, and graphite; or is coated with an oil lubricant.

7. A process according to claim 5, wherein:

after rinsing the phosphate conversion coating with water, the coating is neutralized before performing operation (II); and an aqueous solution of an alkali metal salt of a $C_{16}$ to $C_{18}$ fatty acid is applied over the neutralized phosphate coating, so as to form by reaction with the zinc phosphate coating film a layer of zinc salt of said fatty acid.

8. A process according to claim 3, additionally comprising an operation of rinsing the phosphate conversion coating formed in operation (I) with water before performing operation (II).

9. A process according to claim 8, wherein:

after rinsing the phosphate conversion coating with water, the coating is dried before performing operation (II); and in operation (II), the outer surface of the dried phosphate conversion coating is:

coated with a solid lubricant selected from the group consisting of molybdenum disulfide, tungsten disulfide, and graphite; or is coated with an oil lubricant.

10. A process according to claim 8, wherein:

after rinsing the phosphate conversion coating with water, the coating is neutralized before performing operation (II); and an aqueous solution of an alkali metal salt of a $C_{16}$ to $C_{18}$ fatty acid is applied over the neutralized phosphate coating, so as to form by reaction with the zinc phosphate coating film a layer of zinc salt of said fatty acid.

11. A process according to claim 2, additionally comprising an operation of rinsing the phosphate conversion coating formed in operation (I) with water before performing operation (II).

12. A process according to claim 11, wherein:

after rinsing the phosphate conversion coating with water, the coating is dried before performing operation (II); and in operation (II), the outer surface of the dried phosphate conversion coating is:

coated with a solid lubricant selected from the group consisting of molybdenum disulfide, tungsten disulfide, and graphite; or is coated with an oil lubricant.

13. A process according to claim 11, wherein:

after rinsing the phosphate conversion coating with water, the coating is neutralized before performing operation (II); and an aqueous solution of an alkali metal salt of a $C_{16}$ to $C_{18}$ fatty acid is applied over the neutralized phosphate coating, so as to form by reaction with the zinc phosphate coating film a layer of zinc salt of said fatty acid.

14. A process according to claim 1, additionally comprising an operation of rinsing the phosphate conversion coating formed in operation (I) with water before performing operation (II).

15. A process according to claim 14, wherein:

after rinsing the phosphate conversion coating with water, the coating is dried before performing operation (II); and in operation (II), the outer surface of the dried phosphate conversion coating is:

coated with a solid lubricant selected from the group consisting of molybdenum disulfide, tungsten disulfide, and graphite; or is coated with an oil lubricant.

16. A process according to claim 14, wherein:

after rinsing the phosphate conversion coating with water, the coating is neutralized before performing operation (II); and an aqueous solution of an alkali metal salt of a $C_{16}$ to $C_{18}$ fatty acid is applied over the neutralized phosphate coating, so as to form by reaction with the zinc phosphate coating film a layer of zinc salt of said fatty acid.

17. A process according to claim 10, wherein the contacting of operation (I) is performed by immersing said workpiece surface in said phosphating composition for from 2 to 20 minutes while the composition is maintained within a temperature range from 35 to 80° C.

18. A process according to claim 9, wherein the contacting of operation (I) is performed by immersing said workpiece surface in said phosphating composition for from 2 to 20 minutes while the composition is maintained within a temperature range from 35 to 80° C.

19. A process according to claim 8, wherein the contacting of operation (I) is performed by immersing said workpiece surface in said phosphating composition for from 2 to 20 minutes while the composition is maintained within a temperature range from 35 to 80° C.

20. A process according to claim 1, wherein the contacting of operation (I) is performed by immersing said workpiece surface in said phosphating composition for from 2 to 20 minutes while the composition is maintained within a temperature range from 35 to 80° C.

* * * * *